US006945770B1

(12) United States Patent
Blaschke et al.

(10) Patent No.: US 6,945,770 B1
(45) Date of Patent: Sep. 20, 2005

(54) FUEL METERING PUMP OF A HEATING EQUIPMENT, PARTICULARLY WATER OR AIR HEATING EQUIPMENT OF A MOTOR VEHICLE, WITH CONTROL EQUIPMENT

(75) Inventors: Walter Blaschke, Esslingen (DE); Günter Eberspach, Wolfschlugen (DE); Dieter Götz, Kirchheim (DE)

(73) Assignee: J. Eberspacher GmbH & Co. KG, Esslingen (DE)

( * ) Notice: Subject to any disclaimer, the term of this patent is extended or adjusted under 35 U.S.C. 154(b) by 0 days.

(21) Appl. No.: 09/868,996

(22) PCT Filed: Dec. 15, 1999

(86) PCT No.: PCT/EP99/09950

§ 371 (c)(1),
(2), (4) Date: Jan. 9, 2002

(87) PCT Pub. No.: WO00/37855

PCT Pub. Date: Jun. 29, 2000

(30) Foreign Application Priority Data

Dec. 22, 1998 (DE) ..... 198 59 319

(51) Int. Cl.[7] ..... F23N 5/20

(52) U.S. Cl. ..... 431/12; 431/39; 237/12.3 C; 237/32; 702/50

(58) Field of Search ..... 431/12.18, 89; 237/12.3 C, 32; 137/92; 73/54.23; 702/50

(56) References Cited

U.S. PATENT DOCUMENTS

| | | | | |
|---|---|---|---|---|
| 2,031,018 | A * | 2/1936 | Thomas | 137/92 |
| 2,072,761 | A * | 3/1937 | Lum | 431/89 |
| 2,158,359 | A * | 5/1939 | Finnigan | 431/89 |
| 3,493,345 | A * | 2/1970 | Windley | 137/92 |
| 3,894,832 | A * | 7/1975 | Chin et al. | 431/12 |
| 5,311,447 | A * | 5/1994 | Bonne | 73/25.03 |
| 5,486,107 | A * | 1/1996 | Bonne | 431/89 |
| 5,545,012 | A | 8/1996 | Anastos et al. | |
| 5,761,627 | A | 6/1998 | Seidel et al. | |

FOREIGN PATENT DOCUMENTS

| | | |
|---|---|---|
| DE | 42 39 652 A1 | 11/1992 |
| EP | 0 270 277 A1 | 11/1986 |
| EP | 0 687 436 A1 | 5/1995 |

* cited by examiner

*Primary Examiner*—Sara Clarke

(57) ABSTRACT

The invention relates to an electric fuel dosing pump (2) of a heating device (1), especially a water heating device in the form of a an auxiliary heater or an independent heating device of an automobile, having a control device (5) for controlling the dosing pump and optionally the heating device. The invention is characterized in that hydraulic/pneumatic states (Z) and parameters (F, N) of the fuel medium are detected in a signal detector (6) by means of the electrical behavior of the fuel dosing pump (2), especially the flow rate, and evaluated in said control device (5) for regulating the dosing pump (2) and optionally the heating device (1), especially also the fan motor (3) and the ignition device (4).

10 Claims, 1 Drawing Sheet

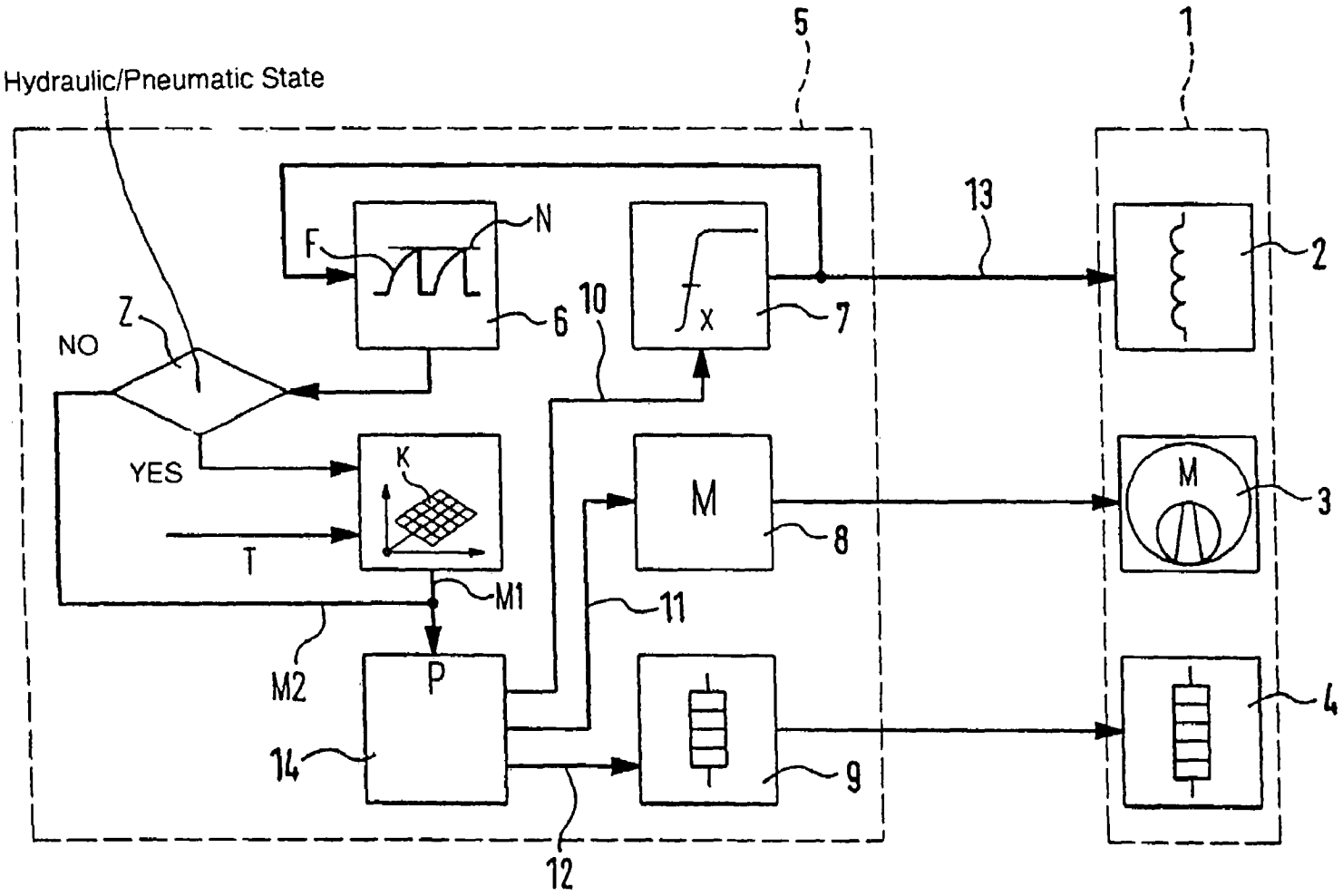
1
2
3
4
M
13
5
7
8
9
x
M
11
10
12
6
N
F
K
M1
P
M2
14
T
YES
NO
Z
Hydraulic/Pneumatic State

FUEL METERING PUMP OF A HEATING EQUIPMENT, PARTICULARLY WATER OR AIR HEATING EQUIPMENT OF A MOTOR VEHICLE, WITH CONTROL EQUIPMENT

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

The invention relates to an electrically operated fuel metering pump of a heating equipment, particularly a water heating equipment in the form of booster heating means or standstill heating means of a motor vehicle, with a control equipment for the metering pump drive and if necessary for the heating equipment, and also a process for the control of said heating equipment with an electrically operated fuel pump.

TECHNICAL BACKGROUND

For the operation of independent heating equipments in a motor vehicle, metering pumps are usually used for atmospheric vaporizer burners.

For the reliable starting and operation of the heating equipment, all the components are as a rule monitored by the control equipment. The control equipment usually has a high performance microprocessor. The microprocessor monitors the components to be driven, such as glow plug, burner motor, sensors, and metering pump, for interruption and short-circuit. As a rule, most equipments have a rotation speed control or voltage control.

Thus it can be assumed, with normally functional and correctly designed components, that all components fulfill their function for a reliable start and also heating operation.

This means, in detail:

The burner motor rotates, and thus combustion air is present;

The glow pin has no short-circuit and no interruption. Thus an intact glow pin can be assumed.

The fuel metering pump has no short-circuit and no interruption, and thus is in order electrically.

However it cannot be known whether the metering pump also supplies fuel. This means that the hydraulic state is unknown. Thus in the case of a failure to start or a cessation of normal operation, no opinion is possible as to whether there was a lack of fuel or which medium is forwarded at the moment.

SUMMARY OF THE INVENTION

The invention has as its object to provide an electrically operated fuel metering pump, together with control equipment, of the kind mentioned at the beginning, in which by means of simple and reliable measures (besides the electrical operation) a further monitoring and control takes place.

The object of the invention is attained by an electrically operated fuel metering pump of a heating equipment or a standstill heater of a motor vehicle, comprising a control equipment for a drive of the fuel metering pump and if necessary of the heating equipment, wherein hydraulic/pneumatic states and parameters of a fuel medium are detected in a signal detector by electrical control equipment for control of the metering pump and if necessary of the heating equipment.

Hydraulic/pneumatic states and parameters of the fuel are detected in a signal detector by means of the electrical behavior of the fuel metering pump, and are evaluated in the control equipment for the control of the metering pump and/or of the heating equipment, particularly of the fan motor and/or the ignition device of the heating equipment.

The metering pump includes an electric motor as drive means or an electromagnetic coil with armature and pump piston as the medium forwarding means, the electrical behavior being detected in the form of a characteristic course of the motor or coil current signal.

The course of the signal is in particular distinguished by a characteristic slope of the rising flank and/or a characteristic level or plateau, which is/are associated with a solid or liquid pumping medium and/or the viscosity of a pumping medium (gas/air, fuel, oil).

For an evaluation of an actual current signal with respect to a pumping medium in the fuel metering pump, a significant set of medium parameters is laid down in the control equipment, and includes a set of temperature slope parameters and is in particular designed for diesel fuel and/or PME as the medium.

A process according to the invention for the control of a heating equipment with a fuel metering pump thus in particular provides that hydraulic/pneumatic states and parameters of the fuel medium are detected in a signal detector of the control equipment by means of the electrical behavior of the fuel metering pump, particularly by means of the course of the current, and are evaluated in the control equipment, in which medium parameters and heating equipment parameters, particularly ignition parameters, are laid down, for detection of the medium, and are in particular used for an adjustment or corrective drive of the metering pump and/or an adjustment or a corrective drive of the fan motor and/or an adjustment or corrective drive of the ignition device or adjustment of the ignition parameters of the heating equipment.

The metering pump includes in particular a coil, which upon application of a voltage produces a magnetic field, which attracts the pump piston and thus initiates the forwarding stroke. Since there exists a density difference with a factor of about 700 between air and e.g. diesel fuel, this becomes apparent in the coil current, as has been found by tests with an oscilloscope. A typical course of the signal is formed when air is forwarded, and also a typical course of the signal when a liquid is forwarded.

It is thus possible to distinguish between the gas medium (air) and the liquid medium (fuel), by means of the characteristic course of the signal.

It is furthermore possible to ascertain viscosity differences. Since the piston movement is strongly throttled in the case of liquids of high viscosity, the slope of the rising flank of the signal course, and also its level, are altered.

Since the viscosity depends on the kind of medium (air, fuel, oil), and also on the temperature, it is possible to determine the medium at present being used by means of a set of temperature slope characteristics laid down in the control equipment.

The evaluation of the slope change can take place similarly to, or the same as, a trend evaluation for flame detection. Since other preheater and stabilization times are applicable for diesel and PME (vegetable methyl ester, or "biodiesel") when starting the heating equipment, the control equipment parameters can be adjusted when, for example, the medium detection detects PME.

In particular, an evaluation is possible when the viscosity of the media differs strongly at the same temperature.

Thus it is basically possible to detect the hydraulic states and parameters by means of the electrical behavior (course of the current signal) of the metering pump. This makes possible different start routines, and also a differentiated fault detection (e.g., exceeding the safety time due to lack of fuel can be excluded), an accelerated forwarding by the metering pump when air is detected (e.g., when first putting into service), and also a differentiation between diesel and PME, and thus an adjustment of the ignition parameters.

As a result, a heating operation of the heating equipment which is improved over the prior art, and in particular is more reliable, is thus possible by means of the invention. A single control equipment is sufficient for PME and diesel fuel.

The invention is described in detail hereinbelow using a circuit diagram showing the principle of a heating equipment in the form of an auxiliary heating equipment with metering pump and control equipment.

BRIEF DESCRIPTION OF THE DRAWINGS

The FIGURE shows a schematic view of the motor vehicle heating equipment and control equipment.

DETAILED DESCRIPTION OF THE INVENTION

The FIGURE shows that the motor vehicle heating equipment 1 includes (among other things) a fuel metering pump 2, a fan motor 3, and an ignition device 4 which are driven in a known manner via a control equipment 5 by means of control devices 7, 8 or 9.

The fuel metering pump 2 has an electromagnet coil which is supplied with current 13 through the control device 7 of the control equipment 5, and on the application of a voltage produces a magnetic field which attracts the pump piston and thus initiates the forwarding stroke.

Here the invention is stated:

The hydraulic/pneumatic state Z and parameters of the fuel medium are detected in a signal detector 6 by means of the electrical behavior of the fuel metering pump 2, and are evaluated in the control equipment 5 for a control, not only of the metering pump 2, but also of the whole heating equipment 1, in particular also of the fan motor 3 and of the ignition device 4.

The electrical behavior is detected here in the form of a characteristic course of the signal of the coil current 13.

The course of the signal is characterized, in particular by a characteristic slope of the rising flank F and of the level N, which is/are associated with a solid or liquid pumping medium.

If a liquid medium is present, the temperature T of the medium is determined in addition, and the viscosity of the pumping medium is also determined in an evaluation in the form of a bit pattern M1, e.g. for diesel fuel or PME, using a set of medium parameters K laid down in the control equipment 5, with a temperature rise detection.

The bit pattern M1 is then fed to the microprocessor 14 for an adjustment of the heating equipment parameter P in order to carry out driving 10 of the metering pump 2 via the control device 7, driving 11 of the fan motor 3 via the control device 8, and/or driving of the ignition device 4 via the control device 9.

If the evaluation logic of the signal detector 6 finds GAS as the medium, and if in particular a gaseous medium such as AIR is present, the bit pattern M2 for gas or air is fed to the microprocessor 14 for driving the metering pump 2, the fan motor 3, and/or the ignition device 4, corresponding to the gas or the air, in order to initiate, e.g., an accelerated forwarding by the metering pump 2 when air is detected.

What is claimed is:

1. An electrically operated fuel metering pump of a heating equipment comprising a control equipment for the fuel metering pump and if necessary for the heating equipment, wherein hydraulic/pneumatic states (Z) and parameters (F, N) of a fuel medium are detected in a signal detector by electrical behavior of the fuel metering pump, and are evaluated in the control equipment for control of the metering pump and if necessary of the heating equipment.

2. The fuel metering pump according to claim 1, wherein the heating equipment comprises water heating equipment in the form of booster heater or standstill heater of a motor vehicle.

3. The fuel metering pump according to claim 1, wherein the heating equipment comprises at least one of a fan motor and an ignition device.

4. The fuel metering pump according to claim 1, wherein the drive for the fuel metering pump includes an electric motor or an electromagnetic coil with an armature and pump piston as a medium forwarder, and electrical behavior is detected as of a characteristic course of a motor signal or coil current signal.

5. The fuel metering pump according to claim 4, wherein the characteristic course of the signal is distinguished by a characteristic slope of at least one of a rising flank (F) and a characteristic level or plateau associated with at least one of a solid or liquid pumping medium and viscosity of a pumping medium.

6. The fuel metering pump according to claim 5, wherein a set of medium parameters (K) is set forth in the control equipment.

7. The fuel metering pump according to claim 6, wherein the set of medium parameters (K) includes a set of temperature slope parameters.

8. The fuel metering pump according to claim 6, wherein the set of medium parameters (K) is designed for at least one of diesel fuel and PME as the medium.

9. A process for control of a heating equipment having an electrically operated fuel metering pump, comprising the steps of:

detecting hydraulic/pneumatic states (Z) and parameters (F, N) of a fuel medium in a signal detector of the control equipment by electrical behavior of the fuel metering pump, and evaluating the states and parameters in the control equipment, in which medium parameters (K) and heating equipment parameters (P), are set forth, for detection of the medium.

10. The process according to claim 9, further comprising using the states and parameters of the fuel medium in the control equipment for at least one of adjustment or corrective drive of the fuel metering pump, a fan motor, an ignition device and parameters of the heating equipment.

* * * * *